US005196037A

United States Patent [19]

Rossi et al.

[11] Patent Number: 5,196,037

[45] Date of Patent: Mar. 23, 1993

[54] PRODUCTS FOR USE IN POLISHING AND THE LIKE AND PROCESS FOR PRODUCING SAME

[76] Inventors: Robert J. Rossi, 2212 Edgefield Rd., Spartanburg, S.C. 29302; Andreas C. Ladjias, 23 Birch Rd., Kennelon, N.J. 07405; Henry A. Ramella, 208 Woodridge Dr., Spartanburg, S.C. 29301

[21] Appl. No.: 547,808

[22] Filed: Jul. 2, 1990

[51] Int. Cl.[5] ..... B24D 3/00

[52] U.S. Cl. ..... 51/293; 28/111; 51/294; 51/296; 51/298; 106/3; 428/288

[58] Field of Search ..... 51/293, 294, 296, 298; 106/3; 28/107, 111; 428/288, 300

[56] References Cited

U.S. PATENT DOCUMENTS

| | | | |
|---|---|---|---|
| 3,451,885 | 6/1969 | Klein | 28/111 |
| 3,547,608 | 12/1970 | Kitazawa | 51/294 |
| 3,619,149 | 11/1971 | Kitazawa | 51/296 |
| 3,827,112 | 8/1974 | Befere | 28/111 |
| 3,861,892 | 1/1975 | Wisdom, Jr. et al. | 51/295 |
| 3,925,866 | 12/1975 | Lochner | 28/111 |
| 4,018,575 | 4/1977 | Davis et al. | 51/294 |
| 4,227,350 | 10/1980 | Fitzer | 51/294 |
| 4,457,055 | 7/1984 | Ambrose et al. | 28/111 |
| 4,935,295 | 6/1990 | Serafini | 28/111 |
| 5,018,255 | 5/1991 | Bolliand | 28/107 |
| 5,047,281 | 9/1991 | Betz et al. | 428/288 |
| 5,055,341 | 10/1991 | Yamaji et al. | 428/288 |

*Primary Examiner*—Mark L. Bell
*Assistant Examiner*—Willie J. Thompson
*Attorney, Agent, or Firm*—Dority & Manning

[57] ABSTRACT

An improved fibrous composite structure for use in grinding, cutting and/or polishing operations, normally with abrasives. Webs of fibrous materials, preferably blends of fibers having different deniers are fed to a needling apparatus and are needled, starting with at least two such webs. The needles force fibers from the webs along the path of needle travel and withdraw generally clean, leaving voids that define pores. Further individual layers are needled in like fashion to alternating opposite sides of the structure. Needles pass through an amount greater than fifty percent of the then thickness of the structure adequate to produce a unitary composite, though, and most preferably entirely through the thickness. The process for producing the composite products and embodiments of the products are also disclosed and claimed.

23 Claims, 3 Drawing Sheets

PRODUCTS FOR USE IN POLISHING AND THE LIKE AND PROCESS FOR PRODUCING SAME

BACKGROUND OF THE INVENTION

The present invention relates to fibrous products for use in the polishing or other treatment of surfaces with abrasives, chemicals, and the like and to processes for producing same.

Industry has for many years utilized techniques for cutting and polishing glass, metals, stones, crystals and the like in which a pad, substrate or the like is applied against a surface to be treated and with an abrasive material such as cerium oxide, aluminum oxide and the like located therebetween, normally in a slurry form. Pressure applied by the polishing pad or other substrate against the abrasive matrials carried by the slurry imparts a cutting affect on the surface, and depending upon the parameters of the process, a surface being treated may be cut, ground, and/or polished. In similar fashion certain polishing operations have been conducted with chemical formulations only.

Materials to be cut, ground or polished are virtually limitless and include metals, glasses, polymeric compositions, stones, ceramics, crystals and the like. The degree of cutting, grinding and/or polishing is determined by the particular abrasives being used, the particular pads or substrates employed and the particular pressures involved to achieve the desired result.

Certain techniques are designed solely to present a product having a pleasing, aesthetic surface. In many other cases, however, significant criticality is attached to the ultimate finished surface to enable the article or product to function as intended, such as for example, picture tubes for television sets or other video equipment, optical lenses, gem stones, electronic components, and the like, including initial preparation as well as removal of defects therefrom.

The polishing pads are substrates used in the manner aforesaid, and have taken various and sundry forms from a flat planar surface having a predetermined shape to endless bands and/or discrete particles secured to a rotary support member. Likewise, when the particular product or article to be ground and/or polished has a particular three-dimensional shape as opposed to a planar surface, such often dictates the particular size, shape, and/or configuration of the polishing pad that is to be employed.

Many attempts have heretofore been made to fabricate polishing pads of various and sundry shapes and materials to accommodate for the wide variety of uses noted above, and in general, have succeeded in affording some economic and/or technical improvement in the then state of the art processes. Though such improvements have heretofore been made, problems continue to exist for various and sundry reasons. Notably, needled natural and synthetic fibrous felts have been produced and utilized as polishing pads though historically such products have been lacking in uniformity of density, porosity, and the like. Furthermore, historically there have been limits to the thickness of such needled fibrous products though attempts have been made to tack plural layers together to build up a thicker composite polishing pad. Under such tacking conditions needling into adjacent fibrous layers is limited, however, and discrete layers remain with a lack of total cohesiveness therebetween leading to possible delamination of the polishing pad which, of course, would require discarding of same, and may destroy the product or products being treated.

Other attempts have been made to produce composite pads in which discrete fibrous layers have been adhesively secured together. Again, the adhesive interfacial layers present a different effect in the working of abrasives or the like across a work surface than the fibrous pad, leading to possible changes in surface characteristics. Likewise, adhesive bonds are subject fo fail, leading to delamination with same attendant results as noted above.

Other techniques utilized in producing fibrous polishing pads include the carding or other aligning of batts of fibers followed by needling of the batt. Certain of the batts have been built up by the cross-lapping of fibrous webs, followed by needling once the webs of desired thickness weight or the like was obtained. These types of technique are limited to very thin products due to initial fiber bulk.

In still other operations, attempts have been made to orient the fibers in a polishing pad to enhance the effective use of same.

All in all, therefore, considerable effort has been expended in attempting to improve the art of fibrous pads or structures for use in cutting, grinding or polishing of various surfaces.

In recent years, following at least the advent of the poromeric synthetic leather materials the fibrous pads or substrates have been impregnated with porous elastomeric materials. The elastomeric materials employed have often been urethane based and have been variously applied to the fibrous materials from both solvent and aqueous systems. Key to application of the elastomeric materials has been placement of the cured elastomer throughout the fibrous base with a proper field of pores, normally microscopic in size to achieve a uniformly impregnated structure with uniform porosity.

Porosity becomes important in actual use of the finished product in the mechanism of working of the abrasives across the work surface. Notably, as the pad is moved under pressure across the work surface, porosities of the pad continually pick up and expel abrasive slurry in a "pumping action" which adds to uniformity of the action.

Other known-prior art includes U.S. Pat. Nos. 3,000,757; 3,067,483;, 3,100,721; 3,180,853; 3,208,875; 3,284,275; 3,536,553; 3,499,250; 3,504,457; 3,581,439; and 4,728,552, all of which relate to fibrous substrates impregnated with elastomeric materials for polishing operations and the like.

The fibrous structure of the present invention, represents improvement over all of the above prior art and is neither taught nor suggested thereby.

SUMMARY OF THE INVENTION

It is an object of the present invention to provide an improved unitary fibrous material suitable for use in a cutting, grinding, or polishing operation.

Still further another object of the present invention is to provide an improved process for the production of a fibrous polishing substrate suitable for use in a cutting, grinding and/or polishing operation.

Yet further another object of the present invention is to provide an improved polishing pad for grinding, cutting and/or polishing of non-planar surfaces.

Still another object of the present invention is to provide a fibrous substrate for use in a cutting, grinding or polishing operation in conjunction with abrasives in which the substrate is sculptured and with the components of the substrate being of unitary construction.

Generally speaking, the improved fibrous substrate according to the present invention comprises a needled batt of fibers having a thickness of more than one-half inch, said batt being of unitary structure and having pores defined by needle tracks therein from both sides of same, said pores extending adequately beyond fifty percent of the thickness of said batt to produce a unitary structure.

Such batts normally include an elastomer therein of from about 0.2 to about 200 dry weight percent based on the weight of the batt, and have a density as the composite comes off the needling loom in a range of from about 14 to about 480 ounces per square foot uniformly throughout.

More specifically, the improved fibrous product according to teachings of the present invention for the formation of an improved polishing material may be tailored to the particular task for which it is intended. In order to accomplish such, the fibrous batt is fabricated from at least three layers, preferably of blends of different size fibers, and which are needled from opposite sides of same with large or small needles depending upon again the particular polishing operation to which it is to be subjected. Needling in each case most preferably pierces all the thickness of the totality of the layers, though should pierce at least beyond a mid point of the thickness adequate to unify the structure, and preferably at least about seventy-five percent. After fabrication of the unitized fibrous structure according to the present invention, the structure is impregnated with a predetermined weight basis of an elastomeric material which is cured in place throughout the structure, with such structure having a generally uniform density throughout and being of a predetermined size and shape for a particular polishing operation in which it is to be employed. One such improved structure that is achievable due to the greater possible thickness of substrate is a sculptured substrate where raised work surfaces are located above a base and are of unitary construction therewith. There are thus no attached portions for delamination and the product will present same work characteristics as it is worn away, even down to and including the base.

Generally speaking, the process for producing an improved grinding, cutting and/or polishing substrate according to the present invention comprises the steps of feeding at least two layers of fibers, containing predetermined fiber blends to a needling head; needling the two batts with needles designed to force fibers along said batts in a direction of needle movement while returning generally clean, said needle penetration being set to pass entirely through said two batts; feeding a further discrete fibrous layer to one side of said needled structure and subjecting said needled structure and said further layer to further needling with said needles passing adequately beyond fifty percent of the thickness of said material to produce a unitary structure and leaving pores thereat upon withdrawal. Most preferably after needling the first or core layers, the core is turned over and needled from the opposite side. Also, preferably the ultimate structure is needled a like number of times through both sides.

More specifically, utilizing a needling loom that is reinforced and powered to achieve heavy needling, the process according to the present invention comprises the steps of starting with at least two discrete layers or batts of blended fibers and needling entirely through said two batts from both sides followed by alternate introduction of additional discrete fiber batts to alternating opposite sides of said first pair of fiber batts followed by needling to achieve needle penetration adequately beyond fifty percent of the thickness of said then present fibrous batts to achieve a unitary structure. The prescribed needle penetration should occur during each needling pass to ensure unitization of the substrate throughout.

Once the unitized composite fibrous batt is produced in a thickness of from greater than ½ inch to about 2 inches or more depending upon the capabilities of the needle loom, an elastomeric composition may be brought into contact therewith and by capillary action, vacuum conditions or pressure conditions, elastomer may be dispersed uniformly throughout the thickness of the needled fibrous unitary structure. The elastomer is then cured generally in place without substantial migration of elastomer to outside surfaces of said fibrous material. While not so limited to same, in a most preferred arrangement, elastomeric composition where added is aqueous based and includes temperature, pH and/or other condition sensitive curing catalyst material which, when subjected to proper conditions, cures the elastomer. Thereafter, the fibrous structure with cured elastomer therein is treated to remove water and other volatile ingredients followed by pressing under heat and temperature to achieve a predetermined density, and forming to a predetermined size, shape and surface condition appropriate for use in the polishing environs in which it is intended to be employed.

Most preferably, impregnation of the needled fibrous structure with the elastomeric composition proceeds to a point beyond saturation, after which the material is squeezed to expel a predetermined amount of composition therefrom, resulting in a known remaining wet quantity of elastomer composition. Knowing the solids content of the original elastomeric composition, one can then predict the dry solids add-on of elastomeric material to the fiber structure in order to produce a polishing material having desired characteristics.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENTS

Figure 1:
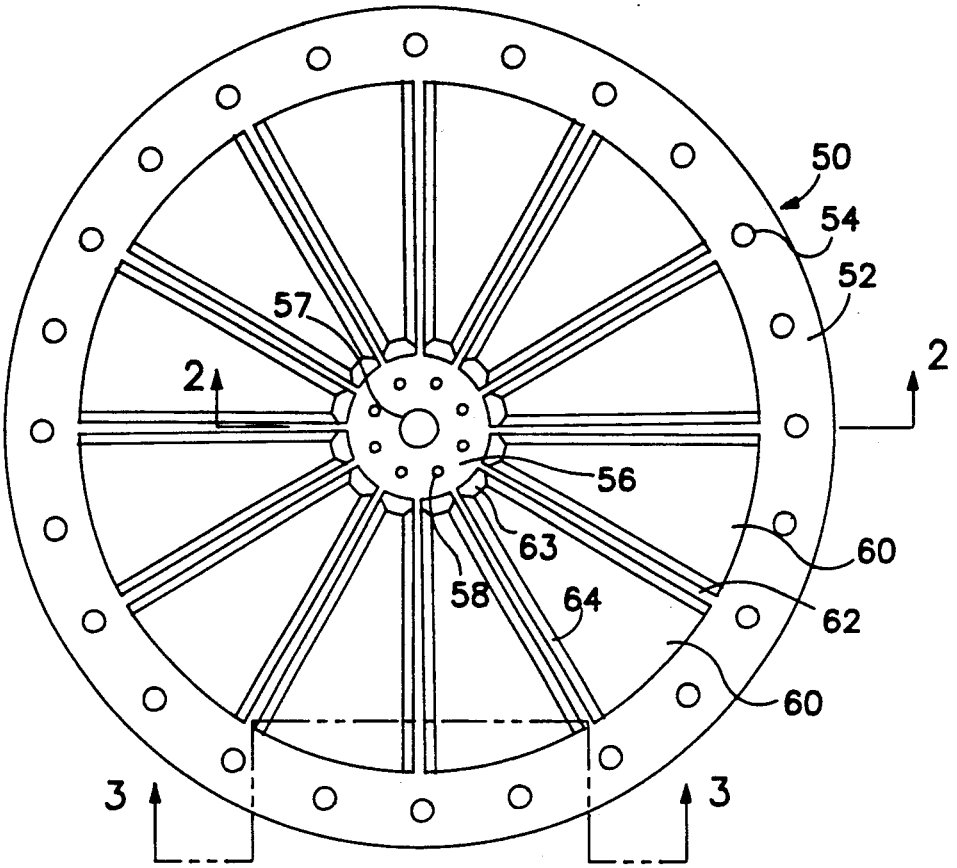
FIG. 1 is a planar view of a polishing pad according to teachings of the present invention illustrating one embodiment that is suitable for polishing of non-planar surfaces exemplified by picture tubes for television sets.

In arriving at an overall grinding, cutting and/or polishing material according to teachings of the present invention, a number of considerations must be made in arriving at a suitable product for use in a particular environment in which it is intended. For example, the degree of cutting, grinding or polishing that is intended for a particular work surface or product to be treated will determine the structure of the polishing pad or substrate that should be produced. By way of example, a rough cut, grind or polish of a particular surface or article in which, speed may perhaps also be an important consideration frequently involves the utilization of a blend of large, medium and small diameter fibrous materials coupled with needling with large needles to define enlarged needle tracks which form elongated pores therealong. More delicate or finer grinding or polishing operations may find a lighter fibrous material formed of medium and smaller diameter fibers and smaller diameter needles most preferable. Obviously also the degree of grinding or polishing may also be affected by a particular abrasive grit or chemical composition that is employed as well as the pressures applied through the pad or substrate against the abrasive. The present invention is capable of use in production of polishing materials for both such uses and those in between.

As set forth herein, while primarily directed to cutting, grinding and/or polishing operations in the presence of abrasive slurries, fibrous composites according to the present invention may also be employed in such operations where only chemical agents are employed, e.g. for final polishing operations, or where a combination of abrasive grit and chemical agents are employed, and the term abrasive should be so construed herein. Any suitable abrasive composition may thus be employed, e.g. slurries of zirconium oxide, carborundum, aluminum oxide, cerium oxide and the like.

Normally composite fibrous structures according to the present invention employ a fibrous blend where the denier or diameter of the fiber is varied. In certain circumstances, however, a structure may be produced from fibers of a single denier, normally in instances where a very light product is needed, so long as the structure retains the necessary porosity. Blends of fibers are, however, highly preferred, and it is believed that blends of different sizes or types of fibers are required for products of a suitable structure for most operations.

In arriving at a suitable blend of fibers to be employed, smaller denier fibers, e.g. three denier or less, may be blended with medium denier fibers, e.g. three to ten denier and larger denier fibers, e.g. ten denier or higher to achieve desired results. The various fibers will interlock into the unitized structure that affords advantages according to the present invention. The particular fibers are preferably blended and carded simultaneously to form a flimsy fibrous layer which is tacked together. Plural fibrous layers are then brought together to form a unitary fibrous structure with further single layers being added alternately to opposite sides of the original needled core structure.

In producing composite structures, at least two batts or layers are fed simulaneously to a needle loom where needles of a predetermined shape, size and in a predetermined density are forced through the fiber layers to at least a zero setting as defined hereinafter. Thereafter, the first needled layers are turned over and needled from the opposite side. Single further layers are then fed with the prior needled structure to the needling apparatus and the two are needled. While most preferably, the needles pass totally through all of the layers then being needled, they should pass at least far enough beyond fifty percent of the then total thickness to achieve a unitary structure. At least seventy-five percent needle penetration is preferred, though one hundred percent is most preferred as noted above.

The term unitary structure is used throughout, and when used, refers to an ultimate structure where, though individual layers were used in fabrication, results in a single layered product which is unitary throughout. In other words, due to the total needling of the layers, all of the layers lose their individual identities, and cannot be separated from the composite in a layer by layer manner.

Figure 5:
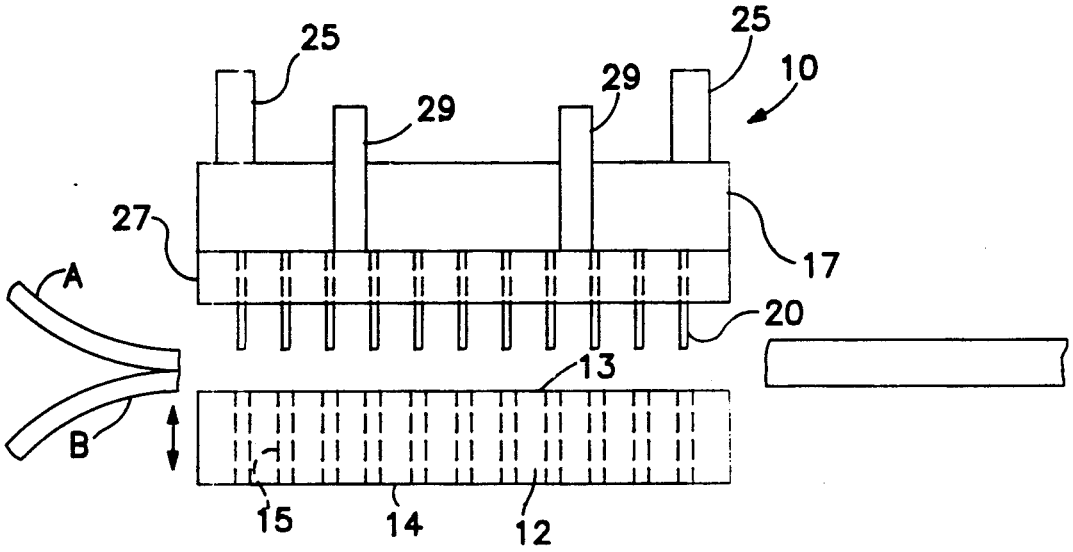
FIG. 5 is a schematic view of a portion of a needling apparatus suitable for fabrication of fibrous structures according to the present invention.

Further, though the needling apparatus described herein and illustrated in FIG. 5 is conventional, double needle apparatus exists where needle penetration could occur simultaneously from each side. The appropriate portion of a needle loom is illustrated and it is believed that one of ordinary skill in the art will readily know the structure of same adequate to understand the operation without further reference.

Needle loom generally 10 is provided with a bed plate 12 having an upper surface 13 and a lower surface 14 and with a plurality of needle receiving openings 15 extending therethrough. A needle bar 17 is located above bed 12 and has a plurality of needles 20 secured thereto and depending therefrom. Needles 20 have corresponding openings 15 in bed plate 12. A power source such as rams 25, which could be powered by any appropriate source, is associated with needle bar 17 to move same up and down. Located between needle bar 17 and bed plate 12 is a stripper plate 27 which is located among needles 20 and is provided with a power source such as rams 29.

A pair of fibrous layers A, B are fed into needle loom 10 between bed plate 12 and needles 20. Rams 25 are then actuated to move needle bar 17 and needles 20 into fiber layer A. Needles 20 are continued in their downward movement and penetrate layers A and B, or continue to penetrate to the extent of downward movement. Zero setting is provided when downward needle movement brings the outer free tips of needles 20 to a line that extends through upper surface 13 of bed plate 12. Stripper plate 22 is then forced downwardly into contact with the upper surface of the upermost fibrous layer by rams 29 as rams 25 retract needles 20.

Needles 20 are designed to engage fibers during movement into the fiber layers and to cause at least certain of the fibers to deflect inwardly with respect to the structure. Upon withdrawal, the fibers that were deflected remain in their downwardly extended position, wherefore the needle is generally clean upon withdrawal. As the needles move through the structure, a needle track is produced which remains after withdrawal to define an elongated pore in the structure. See FIG. 6, for example, where needle track pores 21 indicate needle tracks where the needles entered the structure from the top as illustrated and pores 22 from the bottom as illustrated. In each, fibers F, F', respectively, are schematically shown to represent fibers deflected inwardly by a needle.

Stripper plate 27 thus assists in removing needles 20 from the fibers of layers A, B, etc. Thereafter, layers A and B are reversed, reneedled, and a further fibrous layer C is fed atop layer B (or A) of the now needled core of the composite. In order to accommodate the thickness of layer C, bed plate 12 may be dropped by an appropriate amount. With the third layer in place, needles 20 are brought into contact and forced through the fibers.

In order to withstand the rigors of the forces involved in producing composites according to the present invention, the needle loom should be reinforced at least in the areas described above, Also, while many needle looms have curved plates at the exit ends of same for delivering the needled product to roll up, composites according to the present invention should exit the loom straight and in many uses, cannot be rolled.

Figure 6:
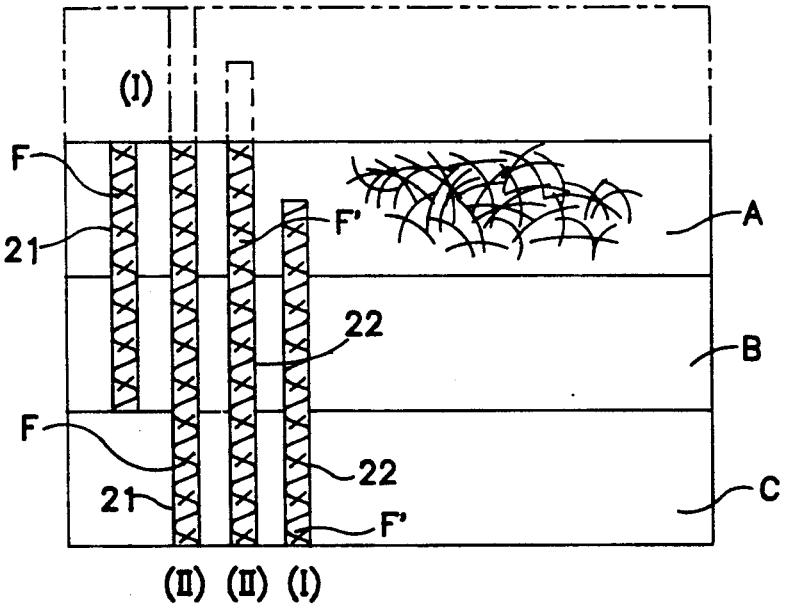
FIG. 6 is a schematic vertical cross-sectional view of a composite fibrous structure according to the present invention.

Needles used in practice of the present invention should force fibers downwardly (inwardly with respect to the structure) along the needle tracks and should release and retract clean. Standard needles are normally employed from about 32 to about 40 guage, and with minimum needle density of about 125 needles per linear meter (each row). While needle density varies with the size of the needle, a generally maximum density is about 21 needles per square centimeter. See for example FIG. 6. In FIG. 6, as noted above, a cross-section of a composite according to the present invention is schematically illustrated. Layers A and B are shown along with a third layer C adjacent an outer edge of layer B. Needle tracks 21, 22 are illustrated, originating from opposite sides and being lined with fibers F, F', respectively, bent in the direction of the bottom of tracks 21, 22. As can be seen, the needle track pores 21, 22 extend from opposite directions, and the depth of each is determined by the number of layers present when needling occurred. For example, track 21 (labeled I) would have occurred when only layers A and B were present with 100 percent penetration, while track 21 (labeled II) and 22 (labeled II) would have occurred with layers A, B and C in place with 100 percent penetration, but from opposite sides. On the other hand, track 22 (labeled I) would have occurred with layers A, B, and C in place with approximately 75–80 percent penetration. FIG. 6 is thus presented to schematically illustrate the fabrication techniques generally only, and not of a specific structure, for during fabrication layers A and B would have been needled from both sides with 100 percent needle penetration, for example. In all instances, a same number of needle passes preferably are made from both sides of the composite, and if during fabrication addition of the last layer results in one side having one more needle pass than the other, the composite should be turned over and reneedled.

Looking again to FIG. 6, the core (layers A and B) would initially be needled from both sides, and if layer C and D were added, then each new layer would be placed on opposite sides of the previously needled core structure for further needling. After the addition of layer D, four needle passes would have been made. The product would thus be balanced and no further needling would be needed.

Composite batts were heretofore produced as noted above, according to the prior art where needling was utilized to only tack an outermost layer of fibrous material to the next adjacent layer and without consideration for totally unitizing the composite structure. While certainly such products worked as polishing materials, the products were non-uniform throughout their thickness and were subject to layerial delamination as a result of same. When, however, according to teachings of the present invention, each needling operation properly penetrates the fibers, preferably at least about three-quarters of the thickness of the then composite batt, the fibers from one layer are adequately forced into and entangled in layers therebeneath to achieve a structure adequately unitary in character that the layers lose definition and cannot be separated.

The particular needles utilized to unitize the fibrous layers according to the present invention are designed to force fibers into the direction of needle movement while permitting generally clean return of the needles. In other words, during needling, the individual needles engage fibers in the path of needle movement and force individual fibers in the direction of needle movement, into entanglement with fibers in other layers, such that layer integrity is not retained in the ultimate composite product. During the return needle stroke in a direction away from the fibrous batt, fibers previously forced into entanglement remain, and the needles retain generally clean. Such action leads to enhanced fiber entanglement and very importantly leaves a void in the composite, coincident with the path of needle travel or needle track. With the addition of each new layer of fiber web, the bed plate on the needle loom, as noted above, is lowered to permit addition of the layer and subsequent to the needling operation, the needled fibrous structure is removed from the needle loom in a straight path as opposed to a curved path in the prior art to avoid undue needle stresses during needling and needle breakage.

After needling the fibrous structure into a unitary composite, the composite is inspected for broken needles which are to be expected when encountering the forces coincident to operation as described above. If found, broken needles are removed.

Fibers that are suitable for use in connection with the present invention are virtually unlimited, and include both natural and synthetic fibers, though the particular fibers being employed may be particularly selected for the end product for which they are intended. In general therefore, so long as a fiber has the strength and other physical characterictics which allow it to be needled into a unitary composite as set forth herein, and so long as the fiber does not possess characteristics that would lead to scratching of the article to be treated thereby, it generally is acceptable for use in accordance with the present invention. Though as mentioned hereinabove, both natural and synthetic fibers may be employed in connection with the practice of the present invention, synthetic fibers are generally preferred due to the ability to consistently manufacture same of a particular size, strength or other physical characteristic such as might be imparted thereto during or subsequent to manufacture by way of texturing, elongation, draw texturing, crimping, heat treating or the like. Such processes can, by way of example, ensure, consistent diameter, bulk, stretch characteristics, setting of molecular configuration in a non-linear arrangement and the like.

Natural fibers that may be used in connection with the present invention include without limitation wool, flax, silk, cellulose fibers such as cotton and the like, and when used should be blended with synthetic fibers. Synthetic fibers for use in the present invention include without limitation polyesters, polyamides, polyolefins, polyaramids, and the like.

As mentioned, the present invention is directed to composite structures that preferably are produced from fiber blends of different diameter or denier ranging from below about three to above about fifteen. In like fashion, ultimate characteristics of a composite structure may likewise be determined to some extent by the fiber length that is employed. In general, as opposed to the utilization of continuous lengths of fibers which normally will not entangle adequately for production of a unitary structure, fibers suitable for use in connection with the present invention include short lengths of fibers referred to frequently as staple fibers. Such fibers may vary in length from about one inch to about four inches, the crucial characteristic being that for the product being produced, fibers employed should have adequate length that during needling, ends of the fibers are needled into adjacent fiber web layers to create sufficient entanglement that a unitary structure is produced that will undergo use without layer delamination.

Insofar as preparation of the fiber layers is concerned, conventional equipment well known to those skilled in the art may be utilized for blending, picking, carding, and/or otherwise producing very light low density layers or webs. Such fibers webs or layers subsequent to carding not only are of low density, but also lack coherency adequate to maintain structural integrity during use. Accordingly, the layers of fibers that are utilized to produce a composite structure according to the present invention are initially tacked to achieve adequate structural integrity for feeding to the needle loom, and the needling or unitizing process affords the ultimate integrity to the composite structure.

While not critical to success of the present invention, thickness of a fiber layer produced from a blending/-carding line or the like may be such as is convenient for production of the composite. It has been found, however, that webs or layers approximately a ¼ inch in thickness are quite adequate, and are preferred, though layers of other thicknesses may be employed.

Once an ultimate composite structure according to the present invention is produced, the composite may be cut into a predetermined size and shape followed by impregnation with an appropriate elastomeric composition or may then be impregnated with an appropriate elastomeric material, and later cut to the size and shape intended.

Elastomeric materials added to fibrous composites according to the present invention are intended, in part, to enhance coherency of the composite. Likewise, the elastomeric component is preferably flexible and may be provided with interconnecting pores throughout. Flexibility, of course, could be important during the cutting, grinding and/or polishing operation to avoid creating scratches or other defects and to permit conformity with the surface being treated. The pore structure throughout the elastomer on the other hand coupled with needle track pores defined in the composite, pumps the abrasive slurry as mentioned above. In fact, with a composite according to the present invention having a porous elastomer secured therein, no break in is required of a new polishing pad. Instead, the pad immediately picks up abrasive slurry and begins to effectively polish or the like.

Elastomers may be added to composites according to the present invention in various forms, namely from solvent or aqueous systems, and in may variations of same. Both types of systems may be employed to suitably secure elastomer in place throughout the composite. Solvent based systems, though technically acceptable, tend to lead to environmental and other problems. One such system involves the application of urethanes of the type disclosed in DuPont's U.S. Pat. Nos. 3,180,853 and 3,284,224, the disclosures of which are incorporated herein by reference.

Urethanes in a molecular weight range of from about 500 to about 300,000 may be utilized. The urethanes conventionally are reaction products of diisocyanates and polymeric materials containing active hydrogen sites such as a polyalkyleneether glycol or a hydroxyl-terminated polyester which are then reacted with a chain extender, all of which is conventional in the art to form polyether or polyester urethanes. The urethane may be dissolved in dimethyl formamide to achieve a composition containing from about 5 percent to about 20 percent urethane. Once the composite is impregnated with the solvent based urethane, the urethane is cured by coagulation, leaching of the solvent and drying as set forth in the patents noted above. Solvents such as dimethyl formamide, however, are fraught with environmental and hazardous problems, wherefore presently such a technique is not desirable.

Alternatively, and most preferably, a water based urethane system is employed which is void of the environmental and hazardous problems alluded to with solvent based systems. Such water based systems are also commercial and in the prior art, and once appropriately impregnated in the composite the urethane is coagulated in place and dried. Urethane constituents in the water based systems may be present up to 60 percent and even higher.

In both the solvent based and water based systems, porosity of the elastomer may be imparted during the coagulation-curing process, as is known in the art. For example, as specified for the solvent based system, water which is partially miscible with the solvent, is added to the system and precipitates polymer, thus forming walls defining pores. Pore size is controlled by the relative percentages of water to solvent and by temperature of the coagulation bath. Other additives can also be included which, depending upon the speed of precipitates control pore size. Exemplary of such examples are silica, carbon black, high molecular weight polymers, etc. See for example U.S. Pat. No. 3,284,224.

In water borne systems, additives which are temperature or pH sensitive are employed to initiate coagulation. For example, a pH sensitive water based urethane may be employed in conjunction with an acid catalyst. When pH of the bath reaches a predetermined level, dependent upon the catalyst, the catalyst effectuates coagulation or precipitates the elastomeric polymer about the fibers. Likewise, pore forming additives may be included in the elastomeric composition, such as blowing agents which produce interconnecting voids or pores throughout the system.

Whichever elastomeric system is employed, it is important the the elastomer be uniformly distributed throughout the composite, that the elastomer be cured in place without migration, and that a proper range of porosity be achieved, if desired. Such ensures ultimate uniformity for the material in its intended use. In fact, desirably 0.2 to 200 dry weight percent elastomer may be added to the present composite based on weight of the composite. With a known composition, an over saturated composite can be compressed to expel elastomer until a known quantity remains. Then one knows the total add on of solids that will remain after curing and drying.

In the overall scheme of the grinding, cutting and/or polishing operation, it is imperative for optimum operation that the composite be as uniform throughout as possible. Hence, once the elastomer has been added to the composite and cured, the composite is preferably subjected to a pressing operation under controlled pressure and temperature conditions to set the composite at a known, controlled density. Likewise, this operation may be utilized to cross link the elastomer for further integrity of the product. Pressures up to about 4000 pounds per square inch are involved, preferably in a range of from about 1400 to about 4000 pounds per square inch, though for certain light weight products, the pressure is very low (around 500 psi or less) and is present only to ensure parallel top and bottom surfaces on the composite. Temperatures in a range of from about room temperature to about 600° F. are present to initiate cross linking in the presence of a crosslinking agent such as a melamine or an azaridine, and preferably somewhere around 225° F. but below the melting point of either the elastomers or the fibers.

During the addition of elastomers to the composite, surface skins of polymer are generally formed. The product is thus appropriately cut or ground to remove the surface skins and expose the underlying porous matrix. Likewise during the cutting or grinding operation, the overall composite size and or thickness can be accurately obtained.

The finishing operation for removal of surface skins also may be utilized for ensuring parallelity of the operative surfaces of the final product as well as precise thickness of same. Finishing may be achieved by controlled grinding and/or cutting of the products, while avoiding temperatures which would glazing and/or sealing of the operative surfaces. During the finishing operation, fiber loops formed during needling are cut, exposing the fiber ends.

Once the composite is finished by one of the techniques noted above, it can then be further fabricated into the ultimate pad for its intended use. Obviously, pieces of composite of a particular size may be cut into squares, etc. which are then mountable on a machine for rotation, oscillation or the like to perform the cutting, grinding, and/or polishing operation. Alternatively, the composite could be sized and formed for receipt as a sleeve about a mandrel or the like for a rotary motion with rotation occurring about an axis through the mandrel, and in certain instances, segments of composite of predetermined shape could be adhesively or otherwise secured to such a mandrel or other support. Each of the above techniques are now employed in the art, though with other composite structures.

Due to the fabrication of the fibrous composites according to the present invention, however, further, unique products may be fabricated therefrom. Exemplary embodiments of such products are illustrated in FIGS. 1 through 4.

In FIG. 1, a polishing pad is illustrated for use in polishing non-planar surfaces such as picture tubes for televisions. FIG. 1 illustrates a sculptured pad generally 50 of unitary construction which outperforms prior art pads in both time of polishing and length of effective life. Pad 50 includes a flange 52 having a plurality of mounting holes 54 spaced thereabout, and with a central base 56 having a centrally located opening 57 and a plurality of openings 58 in circular array thereabout. Pad 50 may thus be mounted to the polishing machine by mounting means passing through peripheral openings 54 and central openings 58. Opening 57 is provided for the pumping of abrasive slurry from a source to the operative surfaces (as seen in FIG. 1) of pad 50. Pad 50 further includes a plurality of pie-shaped segments 60 spaced about central base 56 and with slots 62 defined between each two segments 60.

Figure 2:
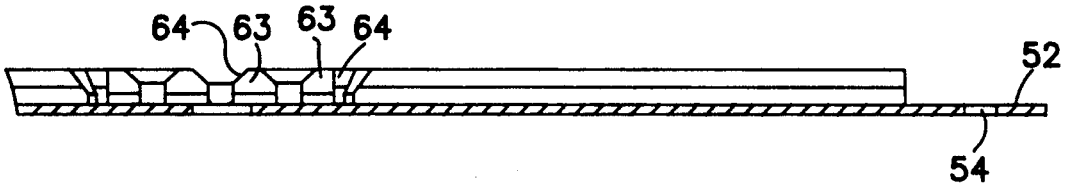
FIG. 2 is an end view of the polishing pad as illustrated in FIG. 1.
Figure 3:
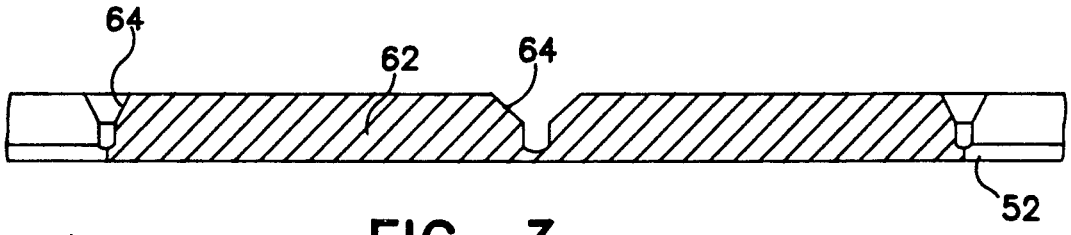
FIG. 3 is a partial cross-sectional view through the polishing pad of FIG. 1 taken along a line III—III.

As best seen in FIGS. 2 and 3, the outermost surfaces of segments 60 extend above flange 52, and slots 62. It is these surfaces that work the abrasive against the article to be polished, etc. Abrasive slurry thus passes through central opening 57 and through radial slots 62 to the pores of pad 50 and onto the outer surfaces, of segments 62. Upper edges of segments 60 are beveled as at 63, 64. As such, the tendency to cause abrasive to bite into the surface being worked is diminished. Also as may be seen in FIG. 3, segments 60 are of unitary structure with the rest of pad 50. Consequently, as segments 62 are eroded or worn down, a continuous like polishing action is achieved even if pad 50 wears down to a point where segments 60 have been completely eliminated. Moreover, segments 60 will not delaminate from pad 50 as do separate portions of prior art structures that are adhesively or otherwise secured to a base.

Pad 50 may thus be produced by cutting, grinding or otherwise sculpturing to provide the desired pattern for the operative surface, and may be tailored for flexing for use in polishing, etc. of non-planar articles, while withstanding the flexural stresses imparted during the operation. In a most preferred operation, pad 50 is cut by appropriately shaped blades, which not only is convenient, but also is very accurate such that all of the grooves, segments, and the like are identical in size and shape, again adding to efficiency during use, and reproducability of result.

Figure 4:
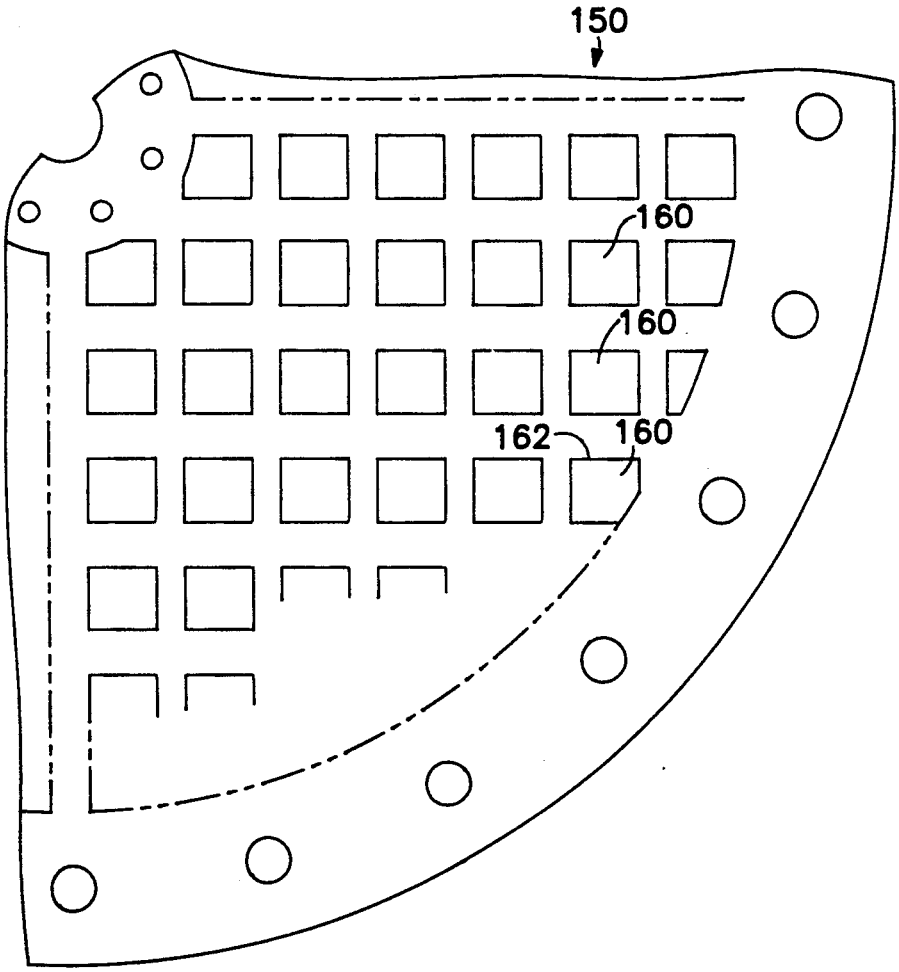
FIG. 4 is a further embodiment of a polishing pad of the type illustrated in FIGS. 1–3 according to teachings of the present invention.

FIG. 4 illustrates a further embodiment of a polishing pad 150 according to the present invention which is identical to pad 50 except that quadrilateral segments 160 are provided in lieu of pie-shaped segments 60 and with slurry grooves 162 around segments 160. It is noted that at the outer periphery of pad 150, only partial segments 160 are provided to retain same within a predetermined circumference.

Obviously in view of the embodiments shown in FIGS. 1 through 4, any other shape could be imparted to a pad, being limited only by the ability to sculpt the design. In fact, computer controlled cutting means may be employed, if desired.

The following examples are provided for a better understanding of the present invention.

EXAMPLE 1

A blend of fibers containing equal quantities by weight of polyester staple fibers of 3 denier, 6 denier, and 15 denier, all three inches in length was produced on a picker mixer and carded on a sixty inch high speed card. Webs from the card were cross-lapped at about 90 degrees and were run through a tacker to form a light weight fiber layer with webs approximating ¼" in thickness. Five layers as described above were fed to a needle loom and needled with 32 gauge needles with total penetration to form a composite core. The core was then turned over and needled in like fashion from the opposite side. Thereafter, a further fibrous layer as produced was added to one side of the fibrous core and the core and new layer were refed to the needle loom and needled as noted above with total penetration. Thereafter, the then needled structure (originally 6 separate layers) was turned over and a seventh layer added to the upper side of same for passage through the needle loom where needling reoccurred. Eighth and ninth layers were likewise added to opposite sides of the composite. The product then removed from the needle loom was of unitary structure, though originally nine separate layers were involved. Sheets were then cut from the unitary substrate producted and padded with a urethane elastomer in an aqueous carrier followed by squeezing to a wet weight of 100 percent pickup. The elastomer composition contained about 50 percent of a commercial pH sensitive urethane, water, a small amount of a melamine cross-linker, and an acid catalyst. The wet unitary substrate was then cured and run through a convection dryer and dried to less than 7% water. Thereafter, the product was pressed at approximately 1400 psi at a temperature of about 225° F. for about 30 minutes during which the urethane was cross-linked. Upon removal from the press, top and bottom surfaces of the product had been made generally parallel by the pressure. Both surfaces were then ground to ensure parallelility and to remove a urethane skin that had formed thereover. The product produced was then utilized along with an abrasive slurry (aluminum oxide) to grind and polish a planar steel surface. It was observed that less slurry was utilized than normal and that the polishing substrate continued to effectively grind for an extended period of time. Compared to conventional pads, the present product enjoyed a useful life of at least twice that of the conventional product.

EXAMPLE 2

Example 1 was repeated with the exception that a 50—50 blend of polyester staple fibers of 3 and 6 denier was utilized in producing the fibrous layers. Five layers so produced were fed to a needle loom equiped with forty gauge standard needles with needling provided as set forth in Example 1. In this Example, however, only one layer was added to each side of the core followed by needling for a total of seven layers. The product produced was of unitary structure and was finished as specified in Example 1 with the exception that the aqueous urethane composition included 20 percent urethane. Also during the pressing step, the pressure plates were only closed onto the product at a pressure of less than 500 psi to form parallel top and bottom surfaces. The product produced performed similarly in a polishing environment to that expressed for the product in Example 1.

EXAMPLE 3

Finished product as produced in Example 1 was sculpted by cutting the upper surface and drilling the appropriate holes as illustrated in FIG. 1 and was then used for the lapping of TV picture tubes in conjunction with cerium oxide slurry. Faster polishing was observed than with conventional prior art polishing structures (about 12 seconds versus about 15-16 seconds). Moreover, it was observed during a number of experiments that products according to the present invention continued to effectively polish even up to the point where the pie-shaped segments as shown in FIG. 1 had completely worn off. Likewise, the products according to the present invention continued and effective for about 2 to about 4 times that of conventional prior art products.

It will be understood, of course, that while the form of the invention herein shown and described constitutes a prederred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A process for producing an improved fibrous composite for use in grinding, cutting and/or polishing of a surface comprising the steps of:

a) feeding at least two juxtaposed layers of blended polyester fibers to a needling apparatus;

b) needling said layers from both sides with total needle penetration therethrough to form a core;

c) feeding said needled core and a further layer of blended fibers to said needling apparatus; and d) needling said core and said further layer with needle penetration adequately beyond fifty percent of the total thickness of said core and said further layer to produce a unitary fibrous product characterized by an absence of any layer definition.

2. A process as defined in claim 1 wherein said unitary product is further needled from an opposite side.

3. A process as defined in claim 1 wherein the fibrous layers contain blends of fibers of different deniers.

4. A process as defined in claim 3 wherein said layers contain fibers having a denier in a range of from about 3 or less, from about 3 to about 10, and about 10 and higher.

5. A process as defined in claim 3 wherein said layers contain fibers having a denier in a range of from about 3 and less and from about 5 to about 10.

6. A process as defined in claim 1 wherein said layers are about ¼ inch thick.

7. A composite fibrous structure for use in abrasive grinding, cutting and/or polishing operations, said structure comprising a blend of fibers, said structure being unitary and more than ½ inch thick and defining needle track pores therein, extending from both sides thereof for a distance adequately above fifty percent of the thickness of the structure to afford the unitary characteristic.

8. A composite structure as defined in claim 7 wherein said structure is more than one inch in thickness.

9. A composite structure as defined in claim 7 wherein said fibers range in denier from less than 3 to more than 16.

10. A composite structure as defined in claim 7 wherein the fibers in the blend include ⅓ fibers having a denier of about 3, ⅓ fibers having a denier of about 6; and ⅓ fibers having a denier of about 15.

11. A composite structure as defined in claim 7 wherein the structure is sculptured to provide operative surfaces of a predetermined design, said operative surfaces being of unitary structure with the rest of the composite structure.

12. A composite structure for use in abrasive grinding, cutting and/or polishing of a surface comprising a unitary fibrous structure having an overall thickness of more than one-half inch, said structure being needled and said needle tracks defining pores that extend from opposite sides of the structure through an amount adequately more than fifty percent of total thickness of the structure to afford the unitary characteristics thereto, portions of said structure being sculptured to define discrete abrasive working surfaces, said abrasive working surfaces defining abrasive passageways therebetween, said structure further defining mounting means receiving openings thereon.

13. A composite structure as defined in claim 12 wherein said structure further defines an abrasive feed opening therethrough, a portion of said structure about said opening being in communication with said abrasive passageways.

14. A composite structure as defined in claim 12 wherein said abrasive working surfaces are generally pie shaped.

15. A composite structure as defined in claim 12 wherein said abrasive working surfaces have a generally quadrilateral configuration.

16. A composite structure as defined in claim 12 wherein said abrasive working surfaces define an outermost surface of one side of said structure.

17. A process of producing a composite structure for use in abrasive grinding, cutting and/or polishing operations comprising the steps of:

a) providing at least two layers containing a fibrous blend of different denier fibers to a needling machine;

b) needling said at least two layers from opposite sides to form a core, said needles passing entirely through said layers, forcing fibers therewith and upon withdrawal leaving void defining pores thereat;

c) refeeding said needled core to said needling apparatus along with a new layer containing a fibrous blend of different denier fibers;

d) needling said new layer and said needled core, said needles passing adequately beyond fifty percent of the thickness of same to form a unitary structure and forcing fibers therewith, and upon withdrawal leaving void defining pores thereat;

e) refeeding said needled structure of step d) to said needling apparatus along with a new layer containing a fibrous blend of different denier fibers, said new layer being applied to an opposite side of said structure to which said last layer was added; and f) needling said previously needled structure and new layer, said needles forcing fibers therewith and passing adequately beyond fifty percent same to form a unitary structure and upon withdrawal leaving void defining pores thereat.

18. A process as defined in claim 17 wherein said fibers are polyester fibers.

19. A process as defined in claim 17 wherein said fiber deniers range from less than 3 to more than 15.

20. A process as defined in claim 17 wherein said needles first pierce the new layer being added.

21. A process as defined in claim 17 wherein further layers are added to the needled structure by needling alternate layers to opposite sides of the structure, said needling forming a unitary structure.

22. A composite structure as defined in claim 12 comprising further a cured elastomeric material uniformly located throughout said structure, operative surfaces of said structure having porosities exposed thereacross.

23. A composite structure for use in grinding, cutting and/or polishing of a surface comprising a fibrous structure having an overall thickness of more than one-half inch, said structure being needled from opposite sides, and having needle tracks extending from opposite sides of same, said tracks defining pores that extend from opposite sides of the structure thereinto by an amount adequately more than fifty percent of the thckness of the structure to afford a unitary characteristic thereto.

* * * * *